US010897797B2

(12) United States Patent
Franciosa

(10) Patent No.: US 10,897,797 B2
(45) Date of Patent: Jan. 19, 2021

(54) METHODS AND SYSTEM FOR CONTROLLING THE SWITCHING ON OF LIGHTS

(71) Applicant: Marco Franciosa, Genoa (IT)

(72) Inventor: Marco Franciosa, Genoa (IT)

( * ) Notice: Subject to any disclaimer, the term of this patent is extended or adjusted under 35 U.S.C. 154(b) by 0 days.

(21) Appl. No.: 16/485,250

(22) PCT Filed: Feb. 26, 2018

(86) PCT No.: PCT/IB2018/051194
§ 371 (c)(1),
(2) Date: Aug. 12, 2019

(87) PCT Pub. No.: WO2018/158671
PCT Pub. Date: Sep. 7, 2018

(65) Prior Publication Data

US 2019/0380181 A1 Dec. 12, 2019

(30) Foreign Application Priority Data

Feb. 28, 2017 (IT) ..... 102017000022336

(51) Int. Cl.
*H05B 45/00* (2020.01)
*H05B 47/18* (2020.01)
*H05B 47/19* (2020.01)

(52) U.S. Cl.
CPC ..... *H05B 45/00* (2020.01); *H05B 47/18* (2020.01); *H05B 47/19* (2020.01)

(58) Field of Classification Search
None
See application file for complete search history.

(56) References Cited

U.S. PATENT DOCUMENTS

| | | | | |
|---|---|---|---|---|
| 5,771,020 | A * | 6/1998 | Markson | G01R 29/0842 342/460 |
| 7,139,617 | B1 * | 11/2006 | Morgan | H05B 47/155 700/17 |
| 7,677,745 | B2 * | 3/2010 | Chien | A43B 1/0036 362/84 |
| 8,378,781 | B1 | 2/2013 | Peterson | |
| 9,113,526 | B2 * | 8/2015 | Stewart | H05B 45/20 |
| 9,888,362 | B2 * | 2/2018 | Conti | G06F 3/1446 |
| 2008/0140231 | A1 | 6/2008 | Blackwell | |

FOREIGN PATENT DOCUMENTS

| | | |
|---|---|---|
| WO | 03067934 | 5/2003 |

* cited by examiner

*Primary Examiner* — K. Wong
(74) *Attorney, Agent, or Firm* — Themis Law

(57) ABSTRACT

A method for controlling the switching on of lights emitted by a plurality of lighting elements includes the following steps: a) arranging the plurality of lighting elements in an environment, b) selecting a switching-on sequence for the lighting elements, and c) executing the switching-on sequence. The method is performed with a plurality of lighting devices, each having one or more lighting elements and a control unit for the one or more lighting elements. Step b) includes the following sub-steps: b1) dividing the switching-on sequence in one or more sub-sequences, associating each sub-sequence to a lighting device, and transmitting the sub-sequences to the control units through a user device. Step c) includes simultaneously having the lighting elements execute each sub-sequence.

10 Claims, 2 Drawing Sheets

METHODS AND SYSTEM FOR CONTROLLING THE SWITCHING ON OF LIGHTS

The present invention relates to a method for controlling the switching on of lights emitted by a plurality of lighting elements.

The method of the present invention comprises the following steps:

a) arranging the plurality of lighting elements within an environment, b) selecting a switching-on sequence for the lighting elements, c) executing the switching-on sequence.

Lighting elements can be composed of lamps or LED lights, and can have different switching-on states, from the simplest ones, that is switched on/off states (for example typical of a simple lamp) to the most varied ones defining also a specific color and lighting power (for example typical of RGB LEDs).

The lighting device is an apparatus comprising a control unit connected to one or more lighting elements, able to set specific switching-on states for each element of the device. A set of specific switching-on states of the lighting elements belonging to a device is called as switching-on configuration.

The switching-on sequence indicates a series of combinations of switching-on states of the lighting elements, where said elements can be switched off or can take different colors and different lighting powers.

Therefore switching-on sequence means a succession of switching-on states, each one characterized by the switching on/off condition, as well as by a specific color and lighting power, taken by a lighting device equipped with one or more lighting elements.

The invention applies to light emission controlling methods aiming at managing light effects and animations by lighting devices having a great number of lighting elements.

In order to provide high scenography quality animations and light effects it is necessary to have lighting devices able to manage a great number of lighting elements.

Moreover lighting devices, in order to provide sophisticated effects and animations, have to guarantee a great variety of switching-on states of the individual lighting elements and a high velocity in transmitting the several switching-on sequences necessary to obtain the desired effect or animation.

The main drawback of prior art known devices and methods is the difficulty in simultaneously controlling a high number of lighting elements with the velocity necessary to obtain desired light effects and animations.

Generally the lighting devices using a high number of lighting elements have several technical critical aspects in individually controlling the single elements.

Firstly there is a power supply problem, since lighting devices, in order to manage a great number of lighting elements electrically connected with one another, besides requiring powerful power supplies and large wires, can have power signal dispersions.

Moreover a main aspect is the ability of the lighting device to accurately and quickly transmit the several switching-on configurations to the lighting elements to obtain the desired effect or animation.

In prior art known devices the transmission of switching-on information is carried out by a serial protocol, that send information to all the devices connected with one another.

The higher the number of lighting elements is, the higher is the variety of switching-on states, the higher is the velocity in changing the switching-on configurations required by the animation, the higher is the amount of information to be transmitted through the serial protocol and the grater is the need for bandwidth to allow all the lighting elements to be simultaneously managed. Therefore as the number of lighting elements increases, the technical complex aspects for managing switching-on states of individual elements increases, both as regards power supply and as regards bandwidth requirement.

If, for example, as regards the type of lighting element, one passes from switched on/off monochromatic LED to a variable brightness RGB LED, a bandwidth about of 25 times higher is required, therefore it is simple to understand how such problem covers a particularly important aspect as the number of lighting elements of a device increases.

In order to manage high numbers of lighting elements therefore it is necessary to use special power supply systems and to increase the bandwidth by means of sophisticated technologies, with a considerable increase in manufacturing and managing costs.

Such problem is a particularly important aspect when the use of lighting elements is intended to obtain a particular decorative or scenography effect.

In case of reproduction of animations or choreographies, the number of the lighting elements and the coordination thereof is of fundamental importance for the success of the animation.

Prior art known systems, for the above reasons, provide devices composed of a limited number of lighting elements connected to a control unit.

Such devices allow lighting elements to be individually controlled, however, although the control operation can be sophisticated, no known device allows characteristics of numerousness of lighting elements, variety of switching-on states and velocity in transmitting the several switching-on configurations to be provided such to allow scenic effects or animations to be generated.

Therefore there is the need not satisfied by systems and methods known in prior art to provide a method for controlling the switching on of lights, as well as a lighting system, able to simultaneously manage a plurality of lighting devices, while guaranteeing a timely and properly synchronized control of switching-on states of the individual lighting elements.

The present invention achieves the above objects by providing a method as described above, where firstly there is provided a plurality of lighting devices, such that each lighting device has one or more lighting elements and a control unit for said one or more lighting elements.

Moreover step b) determining a switching-on sequence of the lighting elements provides the following sub-steps:

b1) dividing the switching-on sequence into one or more sub-sequences;

b2) associating each sub-sequence to a lighting device, b3) transmitting the sub-sequences to the control units through a user device intended to communicate with the control units.

The execution step c) finally provides to simultaneously carry out each sub-sequence by the lighting elements.

It is clear how the method of the present invention solves the above mentioned technical drawbacks, by providing simultaneously to use several lighting devices, each of them connected to a series of lighting elements.

Therefore instead of a single, expensive and complicated lighting device equipped with a high number of lighting elements, the method of the present invention allows several lighting devices independent from one another to be used.

The method steps b1) to b3) allow the lighting devices, physically separated, to be used as a single device.

The user device manages the lighting devices to control lighting elements connected thereto and to transmit the switching-on sequence, executed through the several control units.

Advantages deriving therefrom are clear, besides being easy to install and set the lighting elements the method of the present invention allows a user to obtain effects or animations using all the lighting elements in a synchronized and simultaneous manner.

Once the lighting devices are arranged, the user device is in charge of dividing the switching-on sequence.

In order to obtain more and more complicated and customizable animations, the method of the present invention provides a step a1) following step a), for identifying the position of each lighting element (10*a*-10*q*) within the environment.

The user device can be a common device such as a smartphone or the like. For this reason preferably step b3) regarding the transmission of sub-sequences can be carried out in wireless mode.

Besides being practical in use, such arrangement allows a very wide transmission band to be obtained (for example by using the Wi-Fi network), which is enough to control a high number of devices.

As described above, the main object of the method of the present invention is to consider physically separated lighting devices as a single item, by dividing the switching-on sequence into sub-sequences that are simultaneously handled.

For obtaining this it is possible to provide two alternative solutions.

According to a first embodiment the transmission of said sub-sequences occurs simultaneously for each lighting device.

In this case the user device is always connected to the several control units and such embodiment is particularly useful if the user desires a continuous control on the animation to be created and if he/she desires to eventually modify it.

As an alternative to what just described one embodiment of the method of the present invention provides the transmission of said sub-sequences to comprise a step storing them in each control unit.

According to such arrangement, the user device is only in charge of the division in sub-sequences and of the transmission thereof.

Once the sub-sequences are stored in the several control units, the user device sends a command intended to start the execution of the switching-on sequences, that will be executed by the several devices without the need of a further interaction with the user device.

An improvement of the variant of the method just described provides a step synchronizing the lighting devices.

In absence of an external control or a command, that can be provided by the user device, the synchronization among the several lighting devices is useful to guarantee the proper execution of the switching-on sequence.

Above all in case of long-lasting animations, it is possible for the several control units to be out of alignment resulting in a sub-sequence of a lighting device being carried out in advance or late, creating an undesired effect.

The synchronization solves such drawback.

Moreover on the basis of a possible variant embodiment the synchronization can take place according to the following steps:

defining a primary control unit, sending an activation signal by said main control unit to the secondary control units.

The control unit chosen as the primary unit can for example give periodically a "start of animation" signal to cause the remaining control units to be aligned.

The advantage of such arrangement also is the fact that the communication band among the several control units and the user device is occupied by a simple activation signal, that is a synchronization signal, and not by the entire sub-sequences.

Based on what described above, the method to control the switching-on of lights of the present invention advantageously allows an animation, a switching-on sequence to be selected and to perform it both in presence and in absence of the user device.

Due to the above mentioned advantages, the present invention relates also to a lighting system.

Such system comprises a plurality of lighting elements intended to emit a light and a user device intended to communicate with said lighting elements.

Moreover there is provided a plurality of lighting devices physically separated from one another, composed of a control unit and of one or more lighting elements connected with one another.

The user device communicates with the control units of each lighting device, intended to individually control the switching on of each of said lighting elements belonging to the same lighting device.

It is clear how the lighting system of the present invention provides to use different lighting devices such to manage them as a single object, such to allow switching-on sequences to be carried out that provide the use of a high number of lighting elements.

The lighting system of the present invention is intended to perform the method described above in all its described variants.

For this reason the lighting system provides different embodiments related to the improvements of the method of the present invention and it has all the advantages already described above.

Particularly the user device and the control units can be set to perform all the method steps described above, that is can have processing means and processors to execute a logic program that allows the above steps to be carried out.

For example the user device and the control units can provide wireless communications means.

Moreover the control units can comprise a storage unit, to allow sub-sequences sent by the user device to be stored.

Finally according to a preferred variant embodiment, each control unit is set to cause the lighting elements to perform a specific switching-on sequence, while the user device is set to divide the switching-on sequence into a plurality of sub-sequences and to transmit a sub-sequence to each control unit.

These and other characteristics and advantages of the present invention will be more clear from the following description of some embodiments shown in the annexed drawings wherein.

It has to be noted that the embodiments annexed to the present patent application are disclosed to better understand the characteristics and advantages of the method and system of the present invention.

Therefore such embodiments have to be intended merely for illustrative purposes and not as a limitation to the inventive concept of the present invention, that is to provide a method and system able to consider physically separated lighting devices as a single item, by diving the switching-on sequence into sub-sequences, that are simultaneously managed.

Figure 1:
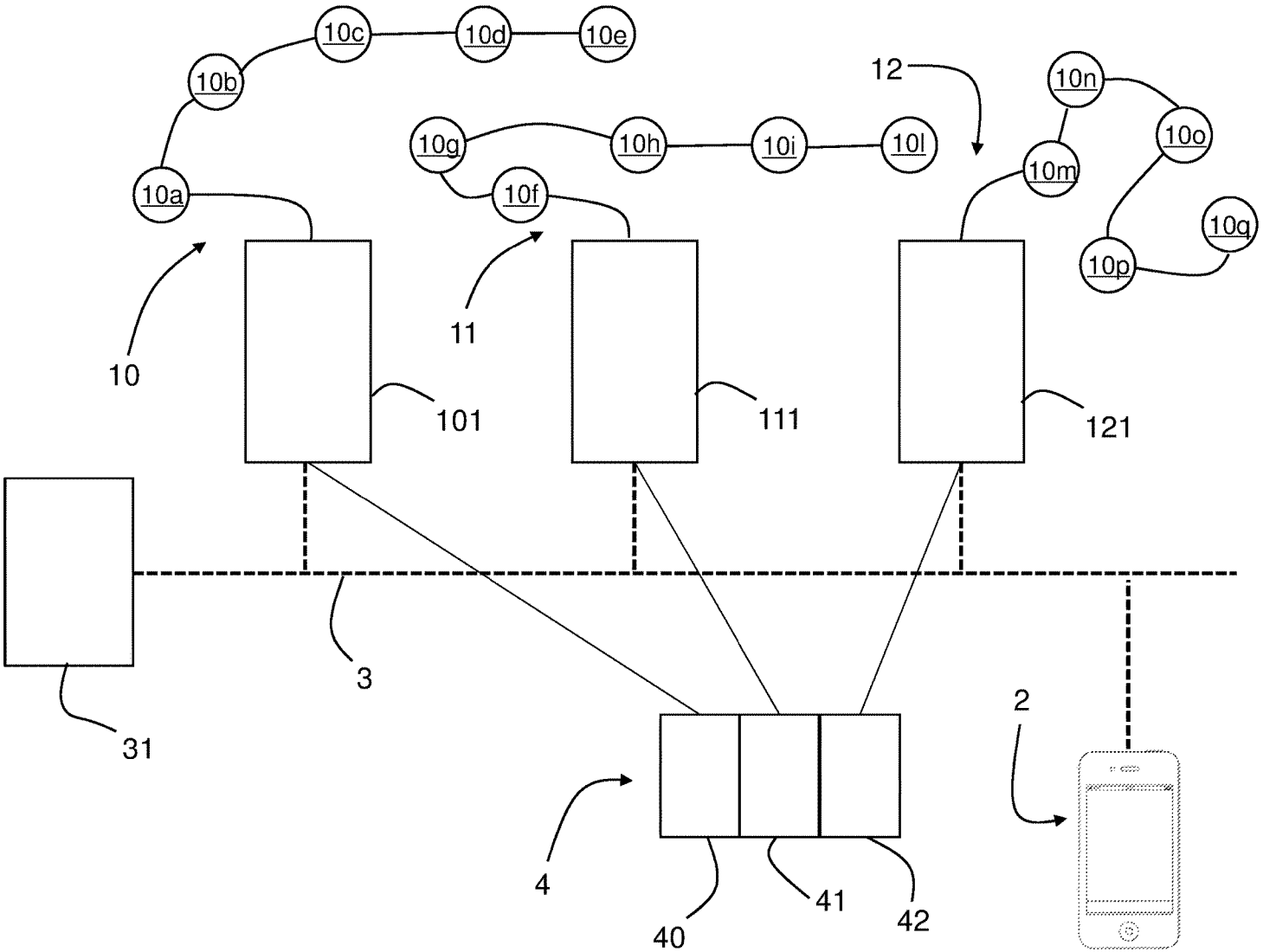
FIG. 1 is a schematic functional block diagram of the method and system of the present invention according to a possible embodiment.
Figure 2:
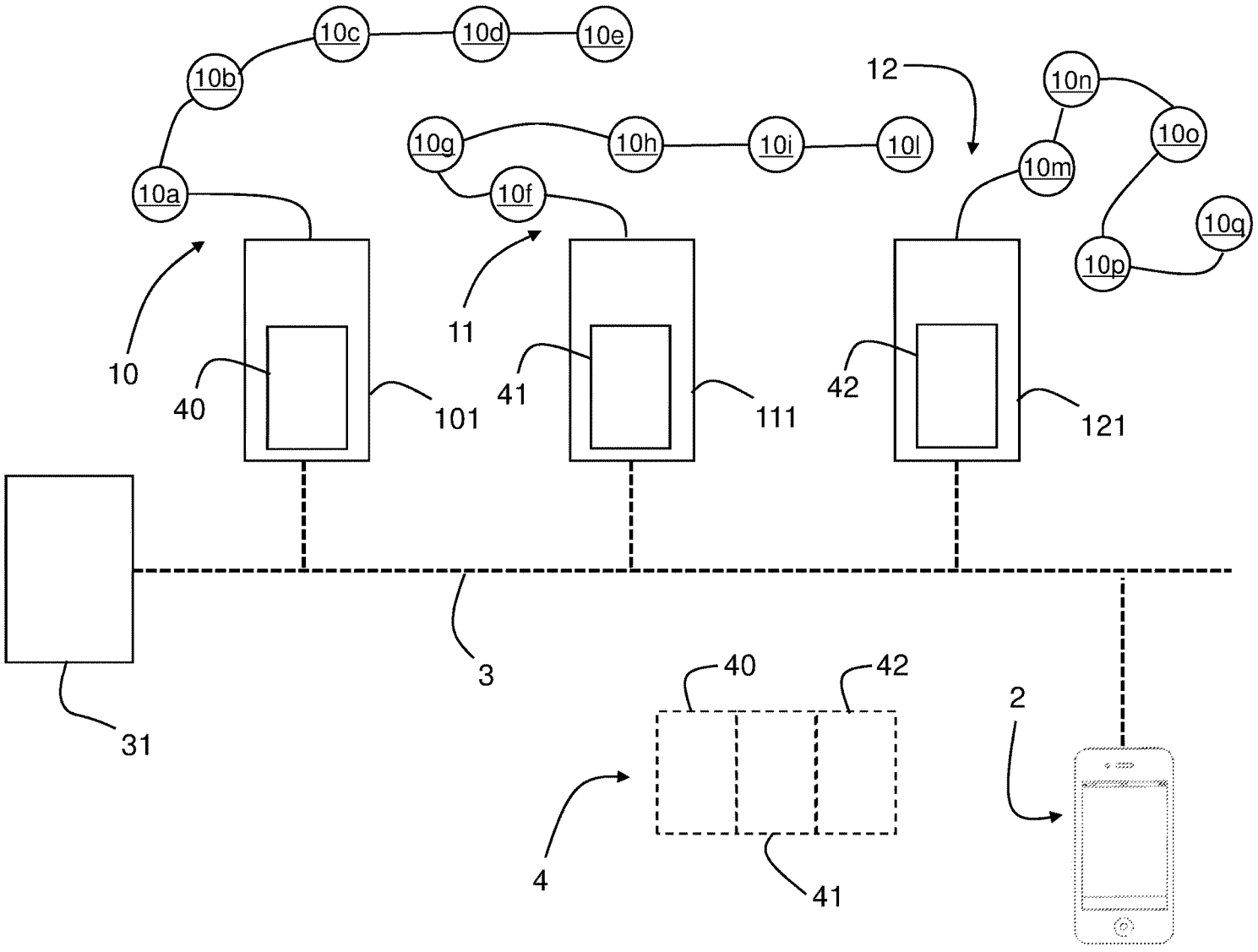
FIG. 2 is a schematic functional block diagram of the method and system of the present invention according to a further embodiment.

With particular reference to FIGS. 1 and 2, shared aspects of the two shown variant embodiments are described herein below.

The lighting system comprises a plurality of lighting elements with numerical references 10*a* to 10*q*, intended to emit a light and a user device 2 intended to communicate with such lighting elements 10*a*-10*q*.

Lighting elements 10*a*-10*q* are divided into three different lighting devices 10, 11 and 12 physically separated from one another.

Moreover each lighting device 10, 11 and 12 comprises a control unit 101, 111 and 121 respectively, intended to individually control the switching on of each of the lighting elements 10-10*q* belonging to the same lighting device.

For illustrative simplicity, FIGS. 1 and 2 provide a number of lighting elements equal for each lighting device, but it is obvious that each lighting device can provide any number of lighting elements, from 1 to the maximum predictable number based on restrictions of the electrical wire connecting them.

The user device 2 therefore communicates with each control unit 101, 111 and 121 of each lighting device 10, 11 and 12.

For example the user device can be composed of a device such as a smartphone tablet or the like, having means running a logic program, such as for example a software application, able to carry out the steps of the method described above.

Preferably the user device 2 and the control units 101, 111 and 121 have wireless communication means.

Therefore a wireless network 3 is created denoted in figure by broken lines.

An access point 31 allows a wireless LAN to be created to which the lighting devices 10, 11 and 12 and the user device 2 are connected, each one at a different address, such to handle transmission/reception of information.

Systems of FIG. 1 and FIG. 2 therefore allow the method of the present invention to be carried out, which initially provides the following steps:

a) arranging the plurality of lighting elements 10*a*-10*q* within an environment.

a1) identifying the position of each lighting element 10*a*-10*q* within the environment, b) determining a switching-on sequence 4 of the lighting elements 10*a*-10*q*, c) executing the switching-on sequence 4 by the lighting elements 10*a*-10*q*.

As mentioned above, in order to carry out the method of the present invention, above all as regards switching-on sequences not requiring complicated animations or customizable light effects, the step a1) identifying the position is not an essential requirement.

Moreover it has to be noted that such step can be obtained according to different methods.

For example the position of the lighting elements can be known beforehand, therefore a predetermined arrangement is possible to be provided, already stored in the user device 2 and/or in the control units 10, 11 and 12.

As an alternative, according to a preferred embodiment, it is possible to provide to identify the space arrangement of the lighting elements such to determine the proper sequence for switching them on to implement a lighting program that provides to switch on the lighting elements according to a predetermined space order.

In this case the position can be identified according to the following steps:

- acquiring a sequence of images of the environment where the plurality of lighting elements is arranged;
- during the acquisition of the sequence of images switching the lighting elements on according to a different sequence, which sequence allows each lighting element to be uniquely identified, namely such to individually identify them (e.g.: one at a time, or generally according to a specific time or color sequence of each element),
- analysing the sequence of images to determine a space position of each lighting element in the environment.

Particularly after installing the lighting elements the user performs a simple initial set-up step by acquiring a sequence of images (e.g. a video) of the environment where the lighting elements are arranged such to determine their space position and to properly control them such to obtain the desired light effect.

Moreover the system of the present invention provides each lighting element to be set such to reply to command messages comprising an identification code of the lighting element itself.

In this case the identification of the position can comprise the steps of:

- arranging the lighting elements in an environment,
- activating each lighting element according to a respective switching-on sequence,
- during the activation of the lighting element acquiring a plurality of images of the environment,
- analysing said plurality of images to determine a space position and an identification code of each lighting element.

Regardless of how the position is identified, step b) determining a switching-on sequence 4 provides the following sub-steps:

b1) dividing the switching-on sequence 4 into one or more sub-sequences 41, 42, 43, b2) associating each sub-sequence 41, 42, 43 to a lighting device 10, 11, 12, b3) transmitting the sub-sequences 41, 42, 43 to the control units 101, 111 and 112 through the user device 2.

Moreover it provides each sub-sequence 41, 42, 43 to be simultaneously carried out by the lighting elements 10*a*-10*q*.

As mentioned above the execution of the proper sequence by the lighting elements 10*a*-10*q* is controlled by the respective control units 10, 11 and 12.

As mentioned above, the lighting elements 10*a*-10*q* can be preferably composed of LEDs that can have different switching-on states and can change the color tone, brightness and saturation.

Accordingly the switching-on sequence can be composed of a high number of possible combinations, by changing the color, intensity or saturation of LEDs.

According to a possible embodiment, it is possible to provide to divide the switching-on sequence on the basis of the identification of the position of the individual lighting elements.

The different switching-on sequences can be completely programmed by the user device 2 or it is possible to select a sequence among the pre-programmed switching-on sequences stored in the user device 2 or in a remote unit to which the user device 2 is connected.

For illustration simplicity it is possible to provide the switching-on sequence to be composed of a kind of flash, that is to provide all the lighting elements 10*a*-10*q*, at a specific time, to emit a white light for a specific time period, then they are switched off.

FIG. 1 shows a first embodiment of the method of the present invention wherein the switching-on sequence 4 is divided into three sub-sequences 40, 41 and 42 by the user device 2.

The user device 2 transmits each sub-sequence to a respective control unit simultaneously for each lighting device 10, 11 and 12.

Supposing to carry out such switching-on sequence as a loop, according to such configuration, the presence of the user device is necessary not only during transmission, but during each cycle, such to establish the beginning of the sequence.

As an alternative to such configuration, FIG. 2 shows a variant embodiment of the method and of the system of the present invention.

With particular reference to FIG. 2 the transmission of the sub-sequences 40, 41, 42 provides a step storing them in each control unit 101, 111, 121.

In this case each control unit 101, 111 and 121 provides a storage unit where sub-sequences 40, 41 and 42 are stored.

The figure shows such step in principle by providing the sub-sequences inserted in the corresponding control units and the sequence 4 shown by broken lines, such to express the concept of the transmission by the user device 2 and the consequent storage in the control units 101, 111 and 121.

The broken line shows the fact that the sequence has been divided and transmitted to the several lighting devices and that it resides inside the control units 101, 111 and 121.

In this case it is clear how the user device 2, once transmitting the sub-sequences 40, 41 and 42, can even stop the communication with control units 101, 111 and 121.

Control units 101, 111 and 121 can be programmed such to carry out the several sub-sequences 40, 41 and 42 as a loop.

According to an improvement of such variant it is possible to provide a step synchronizing the lighting devices 10, 11 and 12 particularly the control units 101, 111 and 121.

Such synchronization step occurs by the following sub-steps:

defining a primary control unit, periodically sending an activation signal by said primary control unit to the secondary control units.

According to a first embodiment, in order to carry out the synchronization, a master control unit and the remaining slave control units are defined, for example on the basis of the connection to the LAN network 3.

For example it is possible to provide the control unit 101 to connect to the LAN network 3, to evaluate the presence of other control units and in case of negative reply it is chosen as the master control unit.

The master control unit 101 can be programmed such that it periodically transmits a signal of the start of the switching-on sequence, such that the start of each sub-sequence 40, 41 and 42 is synchronized and the whole switching-on sequence is not out of alignment among the several lighting devices and such that the lighting elements are perfectly coordinated during the execution of the sequence itself.

As an alternative to such combination it is possible to provide any one of the control units to integrate the access point device 31, such that the synchronization step occurs between such control unit, set as the hot spot of the LAN network 3, and the remaining control units set as client units.

The invention claimed is:

1. A method of controlling a switching on of lights emitted by a plurality of lighting elements, said lighting elements being arranged to provide a plurality of lighting devices, each lighting device having one or more of the plurality of lighting elements and a control unit for said one or more of the plurality of lighting elements, said method comprising the following steps:

arranging the plurality of lighting elements in an environment;

acquiring a sequence of images of the environment, in which the plurality of lighting elements is arranged;

during acquisition of the sequence of images, switching on the lighting elements each with an individual switching-on sequence, so as to uniquely identify each lighting element;

analyzing the sequence of images to determine a spatial position of each lighting element in the environment;

selecting a switching-on sequence for the lighting elements; and executing said switching-on sequence, wherein selecting said switching-on sequence comprises the following sub-steps:

dividing said switching-on sequence in one or more sub-sequences;

associating each sub-sequence to a lighting device;

transmitting said sub-sequences to the control units through a user device adapted to communicate with said control units; and wherein executing said switching-on sequence comprises causing a simultaneous execution of each sub-sequence by the lighting elements.

2. The method according to claim 1, further comprising a step, after arranging the plurality of lighting elements in the environment, of identifying a position of each lighting element within said environment.

3. The method according to claim 1, wherein transmitting said sub-sequences comprises transmitting said sub-sequences via wireless communication.

4. The method according to claim 1, wherein transmitting said sub-sequences comprises transmitting said sub-sequences simultaneously for each lighting device.

5. The method according to claim 1, wherein transmitting said sub-sequences comprises a step of storing said sub-sequences inside each control unit.

6. The method according to claim 5, further comprising a step synchronizing said lighting devices.

7. The method according to claim 6, wherein the step of synchronizing comprises the following sub-steps:

identifying a primary control unit and secondary control units, and sending an activation signal by said primary control unit to the secondary control units.

8. A lighting system comprising:

a plurality of lighting elements adapted to emit a light;

a user device (2) adapted to communicate with said lighting elements; and a plurality of lighting devices physically separated from each other, wherein each of the lighting devices comprises a control unit and of one or more of said lighting elements connected to each other, wherein said user device communicates with said control units, and wherein the control unit of each of the lighting devices is adapted to individually control a switching on of each of said lighting elements belonging to a same lighting device, wherein each control unit and/or the user device is configured to carry out a method having the following steps:

arranging the plurality of lighting elements in an environment;

acquiring a sequence of images of the environment, in which the plurality of lighting elements is arranged;

during acquisition of the sequence of images, switching on the lighting elements each with an individual switching-on sequence, so as to uniquely identify each lighting element;

analyzing the sequence of images to determine a spatial position of each lighting element in the environment;

selecting a switching-on sequence for the lighting elements; and executing said switching-on sequence, wherein step b) comprises the following sub-steps:

dividing said switching-on sequence in one or more sub-sequences;

associating each sub-sequence to one of the lighting devices;

transmitting said sub-sequences to the control units through a user device adapted to communicate with said control units; and wherein executing said switching-on sequence comprises causing a simultaneous execution of each sub-sequence by the lighting elements.

9. The system according to claim 8, wherein said control units comprise a storage unit.

10. The system according to claim 8, wherein each control unit is set to cause said lighting elements to perform a specific switching-on sequence, and wherein the user device is adapted to divide said specific switching-on sequence in a plurality of sub-sequences and to transmit one of said sub-sequences to each control unit.

* * * * *